US008351631B2

(12) United States Patent
Lee et al.

(10) Patent No.: US 8,351,631 B2
(45) Date of Patent: Jan. 8, 2013

(54) BASS SOUND AMPLIFYING ENCLOSURE, WOOFER INCLUDING THE SAME, AND ELECTRONIC DEVICE INCLUDING THE WOOFER

(75) Inventors: Gyeong-tae Lee, Uiwang-si (KR); Jong-bae Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 347 days.

(21) Appl. No.: 12/683,540

(22) Filed: Jan. 7, 2010

(65) Prior Publication Data

US 2011/0019855 A1 Jan. 27, 2011

(30) Foreign Application Priority Data

Jul. 27, 2009 (KR) ..... 10-2009-0068411

(51) Int. Cl.
*H04R 25/00* (2006.01)

(52) U.S. Cl. ..... 381/338; 381/351; 381/388

(58) Field of Classification Search ..... 381/306, 381/337–342, 351, 160–162, 388
See application file for complete search history.

(56) References Cited

U.S. PATENT DOCUMENTS 7,894,620 B2 * 2/2011 Yang ..... 381/351

OTHER PUBLICATIONS

Communication dated Aug. 31, 2012, issued by the Mexican Patent Office in counterpart Mexican Application No. MX/a/2010/003957.

* cited by examiner

*Primary Examiner* — Suhan Ni
(74) *Attorney, Agent, or Firm* — Sughrue Mion, PLLC

(57) ABSTRACT

Provided is an enclosure including a rear chamber, a speaker unit chamber disposed adjacent to the rear chamber and connected to the rear chamber such that air flows between the speaker unit chamber and the rear chamber, a front chamber disposed adjacent to the speaker unit chamber and connected to the speaker unit chamber such that air flows between the speaker unit chamber and the front chamber, and a duct having a first side connected to the front chamber such that air flows between the front chamber and the duct and a second side opened to the outside, wherein the rear chamber, the speaker unit chamber, the front chamber, and the duct are disposed between a first plate and a second plate that are spaced apart from each other.

18 Claims, 7 Drawing Sheets

BASS SOUND AMPLIFYING ENCLOSURE, WOOFER INCLUDING THE SAME, AND ELECTRONIC DEVICE INCLUDING THE WOOFER

CROSS-REFERENCE TO RELATED PATENT APPLICATION

This application claims priority from Korean Patent Application No. 10-2009-0068411, filed on Jul. 27, 2009, in the Korean Intellectual Property Office, the disclosure of which is incorporated herein in its entirety by reference.

BACKGROUND OF THE INVENTION

1. Field of the Invention

Apparatuses consistent with the present invention relate to a bass sound amplifying enclosure, a woofer including the bass sound amplifying enclosure, and an electronic device including the woofer.

2. Description of the Related Art

Electronic devices, such as digital TVs, have recently become thinner owing to the development of flat display panel technology. It may be important to determine types and locations of sound reproduction speakers in order to maintain the thinness of these electronic devices. A bar type speaker installed in a lower bezel below a flat display panel prevents digital TVs from becoming thicker. However, the bar type speaker has a low sound pressure level in a bass sound bandwidth of 100~300 Hz and thus the sound quality thereof is unsatisfactory.

SUMMARY OF THE INVENTION

Exemplary embodiments of the present invention address at least the above problems and/or disadvantages and other disadvantages not described above. Also, the present invention is not required to overcome the disadvantages described above, and an exemplary embodiment of the present invention may not overcome any of the problems described above.

The present invention provides a thin bass sound amplifying enclosure suitable for a slim type electronic device, a woofer including the thin bass sound amplifying enclosure, and an electronic device including the woofer.

According to an aspect of the present invention, there is provided an enclosure include a rear chamber; a speaker unit chamber disposed adjacent to the rear chamber and including a speaker unit which generates a sound vibration; a front chamber disposed adjacent to the speaker unit chamber; and a duct having a first side which is connected to the front chamber such that air flows between the front chamber and the duct and a second side opened to the outside, wherein the rear chamber, the speaker unit chamber, the front chamber, and the duct are disposed between a first plate and a second plate that are spaced apart from each other, wherein the rear chamber and the speaker unit chamber are connected to each other through an aperture formed closer to the first plate than the second plate in a first barrier rib that partitions the rear chamber and the speaker unit chamber, and wherein the front chamber and the speaker unit chamber are connected to each through an aperture formed closer to the second plate than the first plate in a second barrier rib that partitions the front chamber and the speaker unit chamber.

According to another aspect of the present invention, there is provided an electronic device include: a main body which performs a previously established function; and a woofer, attached to the main body, and which amplifies a bass sound, wherein the woofer comprises an enclosure comprising a rear chamber, a speaker unit chamber disposed adjacent to the rear chamber and connected to the rear chamber such that air flows between the rear chamber and the speaker unit chamber, a front chamber disposed adjacent to the speaker unit chamber and connected to the speaker unit chamber such that air flows between the front chamber and the speaker unit chamber, and a duct having a first side connected to the front chamber such that air flows between the duct and the front chamber and a second side opened to the outside, wherein the rear chamber, the speaker unit chamber, the front chamber, and the duct are disposed between a first plate and a second plate that are spaced apart from each other; and a speaker unit which generates a sound vibration disposed in the speaker unit chamber such that a front surface faces the second plate.

A gap between the front surface of the speaker unit and the inner side surface of the second plate may be greater than a maximum vibration amplitude of the speaker unit.

An aperture which disperses the sound vibration generated by the speaker unit may be formed in a portion of the second plate that overlaps the speaker unit chamber and the front chamber.

The aperture formed in the second plate may be closed by a portion of the main body.

A gap between the front surface of the speaker unit and the portion of the main body may be greater than a maximum vibration amplitude of the speaker unit.

An aperture may be formed in a portion of the first plate that overlaps the speaker unit chamber, and the speaker unit may be partially inserted into the aperture formed in the first plate.

The first plate or the second plate may include a reinforcement unit that inhibits vibration and reinforces rigidity.

The rear chamber and the speaker unit chamber may be spaced apart from the duct by the front chamber.

BRIEF DESCRIPTION OF THE DRAWINGS

The above and/or other aspects of the present invention will become more apparent by describing in detail exemplary embodiments thereof with reference to the attached drawings in which.

DETAILED DESCRIPTION OF THE INVENTION

Hereinafter, the present invention will be described in detail by explaining exemplary embodiments of the invention with reference to the attached drawings.

Figure 1:
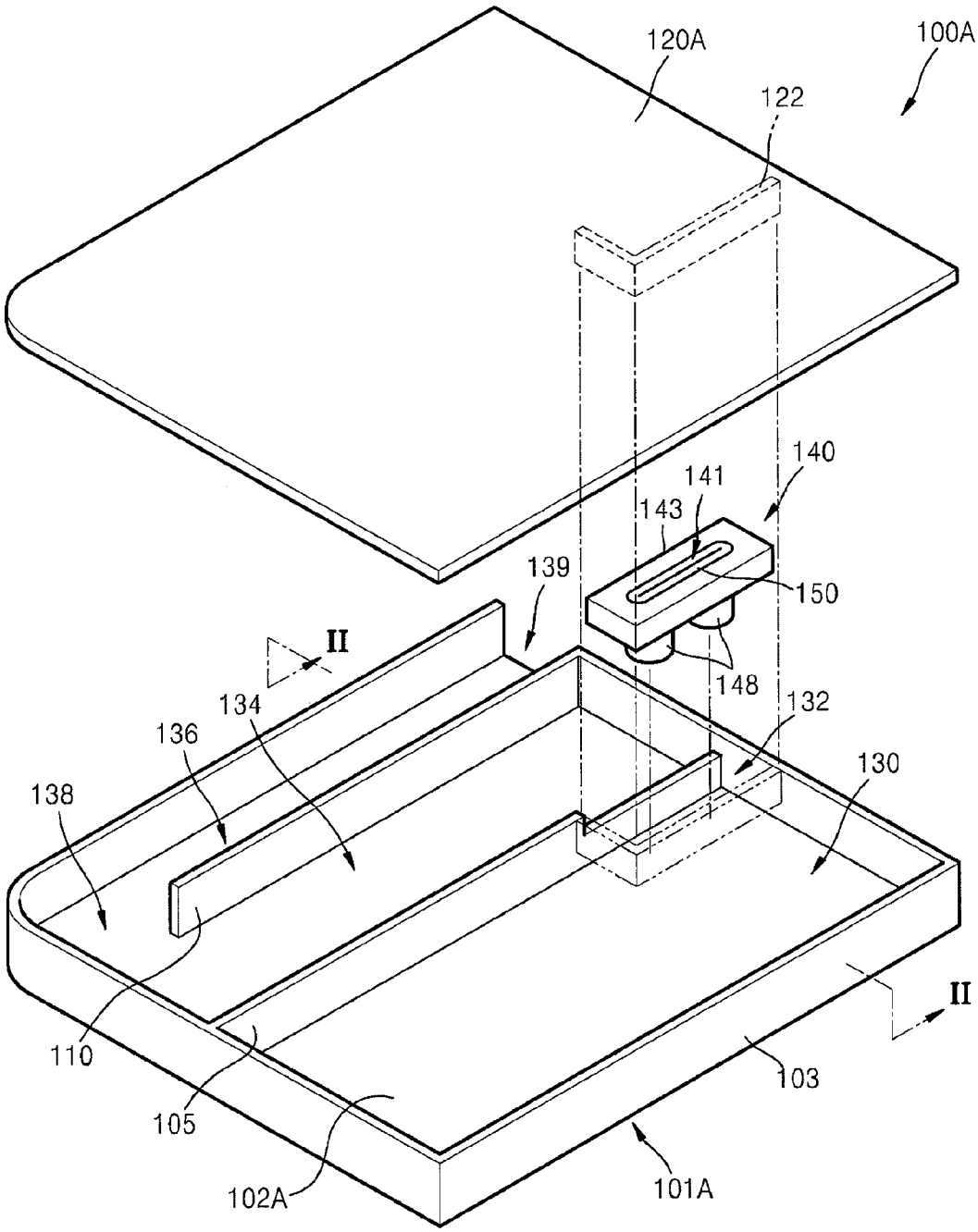
FIG. 1 is an exploded perspective view of a woofer according to an exemplary embodiment of the present invention.
Figure 2:
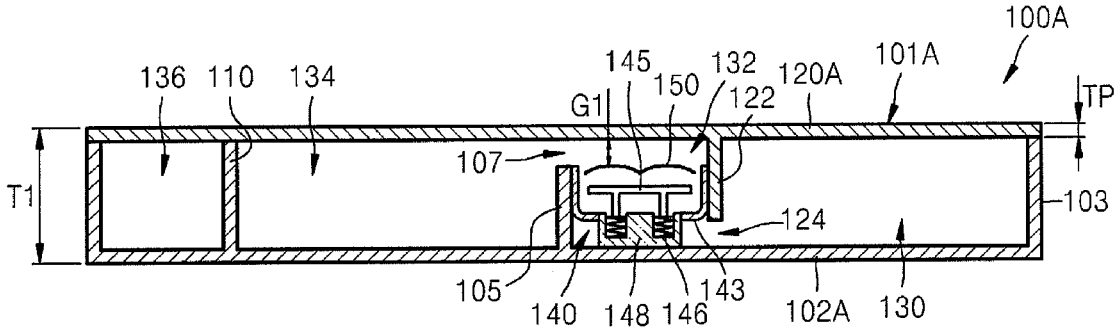
FIG. 2 is a cross-sectional view of the woofer of FIG. 1 taken along a line II-II according to an exemplary embodiment of the present invention.

FIG. 1 is an exploded perspective view of a woofer 100A according to an exemplary embodiment of the present invention. FIG. 2 is a cross-sectional view of the woofer 100A of FIG. 1 taken along a line II-II according to an exemplary embodiment of the present invention.

Referring to FIGS. 1 and 2, the woofer 100A of the exemplary embodiment includes first and second plates 102A and 120A that are in parallel spaced apart from each other, an enclosure 101A including an external wall 103 that is an external boundary, and a speaker unit 140 that is mounted in the enclosure 101A and generates sound vibrations. The first plate 102A and the external wall 103 are integrally formed so that a base is formed. The second plate 120A is coupled to the base so that the enclosure 101A is formed.

The inner space of the enclosure 101A is divided into a rear chamber 130, a speaker unit chamber 132, a front chamber 134, and a duct 136 according to first through third barrier ribs 105, 122, and 110. In more detail, the first barrier rib 105 partitions the rear chamber 130, the speaker unit chamber 132, and the front chamber 134. The second barrier rib 122 partitions the speaker unit chamber 132 and the rear chamber 130. The third barrier rib 110 partitions the front chamber 134 and the duct 136. The first barrier rib 105 and the third barrier rib 110 are integrally formed with the first plate 102A, and the second barrier rib 122 is integrally formed with the second plate 120A.

Although the rear chamber 130 is not directly connected to the outside of the enclosure 101A, in order to facilitate air flow, the rear chamber 130 is adjacent to the speaker unit chamber 132 with the second barrier rib 122 disposed therebetween, with a first connection aperture 124 formed in the second barrier rib 122. The speaker unit chamber 132 is adjacent to the front chamber 134 with the first barrier rib 105 disposed therebetween, and air flow is facilitated through a second connection aperture 107 formed in the first barrier rib 105. The front chamber 134 is connected to one side of the duct 136 through a third connection aperture 138 formed in one side of the third barrier rib 110 in order to facilitate air flow, and the other side of the duct 136 is opened to the outside through a duct aperture 139. Thus, the rear chamber 130 and the speaker unit chamber 132 are spaced apart from the duct 139 by the front chamber 134.

The first connection aperture 124 and the second connection aperture 107 are not disposed in the same level between the first plate 102A and the second plate 120A. In more detail, the first connection aperture 124 is formed closer to the first plate 102A and the second connection aperture 107 is formed closer to the second plate 120A.

The speaker unit 140 is mounted in the speaker unit chamber 132 in such a manner that a front surface 141 in which sound vibration radiates faces the second plate 120A. The speaker unit 140 may be a bar type speaker. The speaker unit 140 includes a frame 143, a vibration plate 150 disposed in the frame 143 and generating sound vibration, a driving body 145 driving the vibration plate 150, and a magnet 148. If current corresponding a sound signal flows in a coil 146 winding around the driving body 145, the driving body 145 and the vibration plate 150 supported by the driving body 145 vibrate in a direction of thickness T1 of the enclosure 101A according to correlations between the driving body 145 and the vibration plate 150 and a magnet 148 and thus sound vibration radiates toward the second plate 120A. The sound vibration radiated toward the second plate 120A is reflected by the second plate 120A, passes through the second connection aperture 107, undergoes the front chamber 134 and the duct 136, and radiates to the outside of the enclosure 101A through the duct aperture 139. The sound radiates to the outside of the enclosure 101A by amplifying a bass sound bandwidth corresponding to a resonance frequency of the duct 136 according to a Helmholtz resonance effect.

A gap G1 between the front surface 141 of the speaker unit 140 and an inner side surface of the second plate 120A is set to be greater than the maximum amplitude of the speaker unit 140 when the sound vibration radiates so that the speaker unit 140 does not prevent the sound vibration from radiating. Further, the gap G1 is set to be smaller than a wavelength (approximately, 1~3 m) of bass sound bandwidth sound that is to be amplified so that a bass sound amplification performance can not be deteriorated. The maximum amplitude of the speaker unit 140 and the vibrating plate 150 may be about 0.6 mm. The gap G1 may be about 2 mm. The thickness TP of the first plate 102A and the second plate 120A may be about 1 mm. The thickness T1 of the woofer 101A may be about 13 mm.

Figure 3:
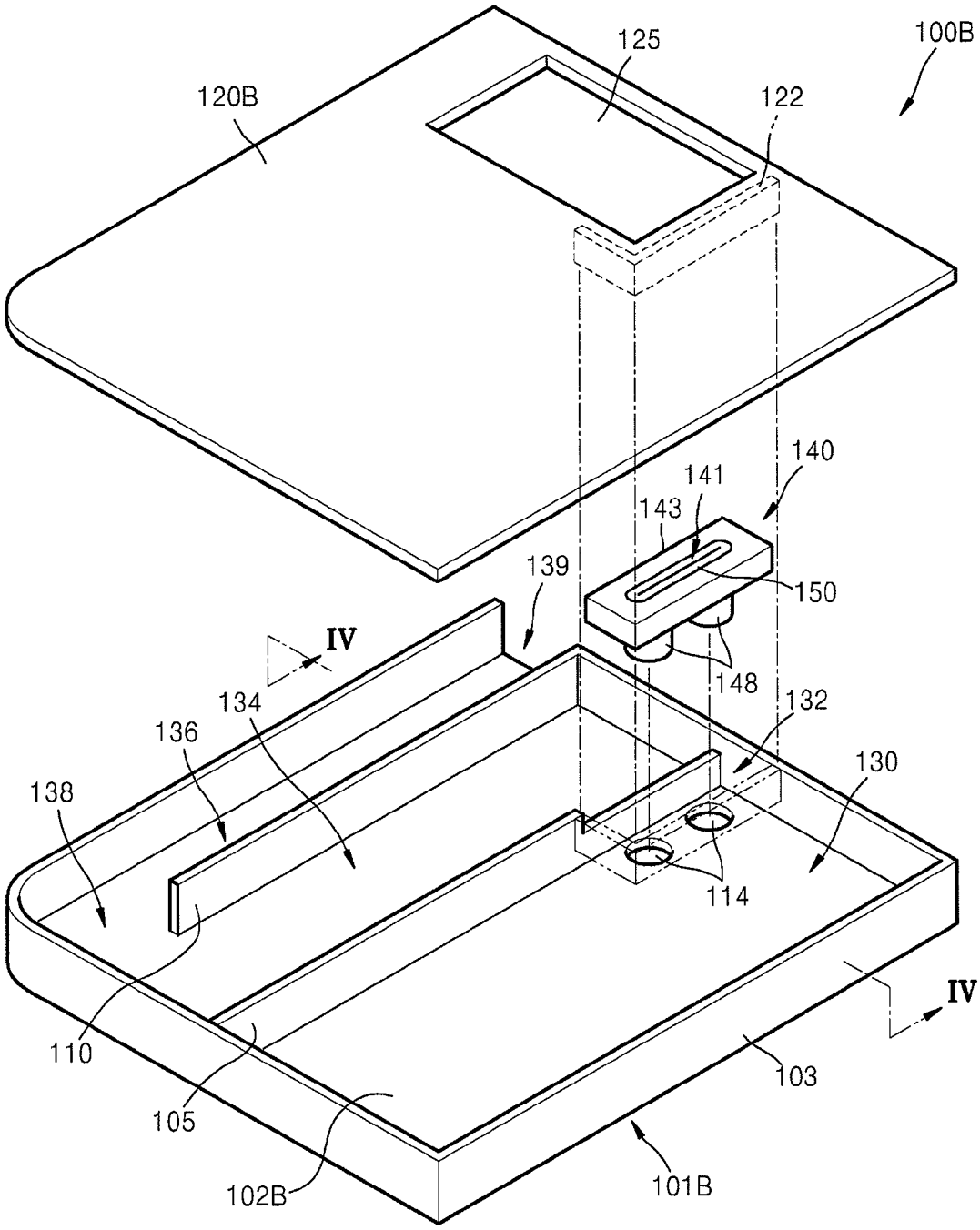
FIG. 3 is an exploded perspective view of a woofer according to another exemplary embodiment of the present invention.
Figure 4:
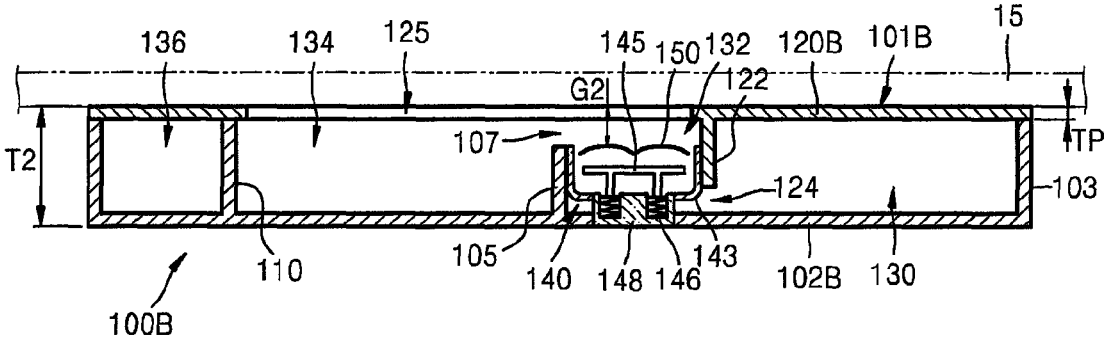
FIG. 4 is a cross-sectional view of the woofer of FIG. 3 taken along a line IV-IV according to another exemplary embodiment of the present invention.

FIG. 3 is an exploded perspective view of a woofer 100B according to another exemplary embodiment of the present invention. FIG. 4 is a cross-sectional view of the woofer 100B of FIG. 3 taken along a line IV-IV according to another exemplary embodiment of the present invention. The woofer 100B of the present exemplary embodiment is quite similar to the woofer 100A of the previous embodiment and is partially different from the woofer 100A. Like reference numerals denote like elements between the woofers 100A and 100B and thus the same descriptions thereof will not be repeated.

Referring to FIGS. 3 and 4, the woofer 100B of the present exemplary embodiment includes first and second plates 102 B and 120 B that are in parallel spaced apart from each other, an enclosure 101B including the external wall 103 that is an external boundary, and the speaker unit 140 that is mounted in the enclosure 101B. The inner space of the enclosure 101B is divided into the rear chamber 130, the speaker unit chamber 132, the front chamber 134, and the duct 136 according to the first through the third barrier ribs 105, 122, and 110.

Figure 6:
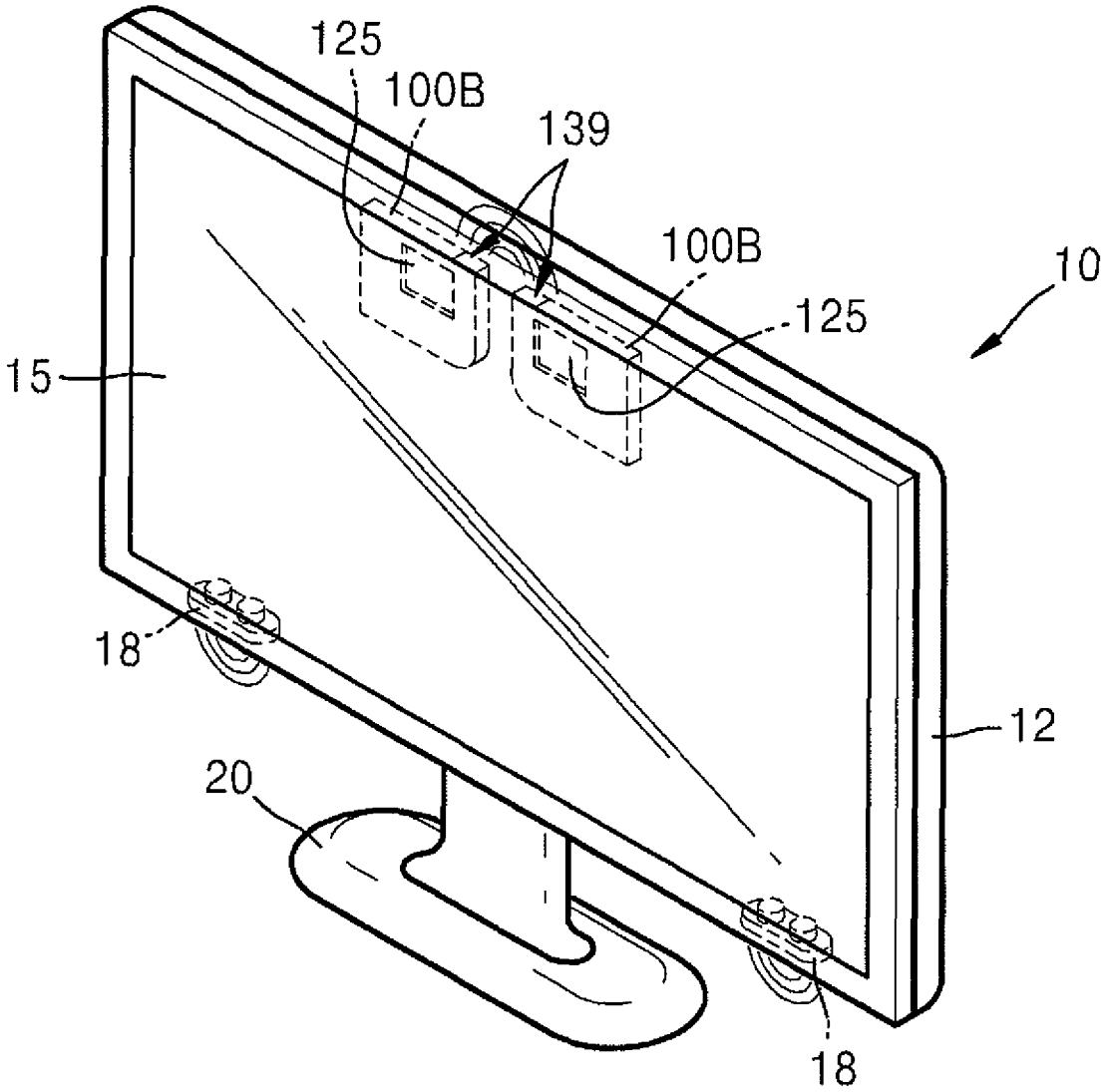
FIG. 6 is a perspective view of an electronic device according to an exemplary embodiment of the present invention.

A magnet aperture 114 is formed in a portion of the first plate 102B that overlaps the speaker unit chamber 132. The magnet 148 of the speaker unit chamber 132 is inserted into the magnet aperture 114. A sound dispersion aperture 125 that disperses sound vibration generated in the speaker unit 140 is formed in a portion of the second plate 120B that overlaps the speaker unit chamber 132 and the front chamber 134. For example, the sound dispersion aperture 125 may be closed by an element of a main body 12 of an electronic device 10 when the woofer 100B is attached to the electronic device 10 as shown in FIG. 6. If the electronic device 10, for example, is a digital TV, the element of the main body 12 may be a flat display panel 15 that is wider and flatter than the second plate 120B, and the sound dispersion aperture 125 may be closed by a rear surface of the flat display panel 15.

The sound vibration radiated in the speaker unit 140 travels forward the sound dispersion aperture 125 of the second plate 120B, is reflected by the rear surface of the flat display panel 15, undergoes the front chamber 134 and the duct 136 through the second connection aperture 107, and radiates to the outside of the enclosure 101B by amplifying a bass sound bandwidth through the duct aperture 139.

A gap G2 between the front surface 141 of the speaker unit 140 and the rear surface of the flat display panel 15, i.e. an inner side surface of the flat display panel 15 facing the enclosure 101B, is set to be greater than the maximum amplitude of the speaker unit 140 when the sound vibration radiates so that the speaker unit 140 does not prevent the sound vibration from radiating. Further, the gap G2 is set to be smaller than a wavelength (approximately, 1~3 m) of bass sound bandwidth sound that is to be amplified so that a bass sound amplification performance can not be deteriorated. The maximum amplitude of the speaker unit 140 and the vibrating plate 150 may be about 0.6 mm. The gap G2 may be about 2 mm. Since the woofer 100B of the present exemplary embodiment further includes the magnet aperture 114 and the sound dispersion aperture 125 compared to the woofer 100A of the previous exemplary embodiment, a gap of the first plate 102B and the second plate 120B may be reduced to the thickness 2 TP of the thickness of the first plate 102B and the second plate 120B. Thus, the thickness T2 of the woofer 100B may be smaller than the thickness T1 of the woofer 100A.

Figure 5A:
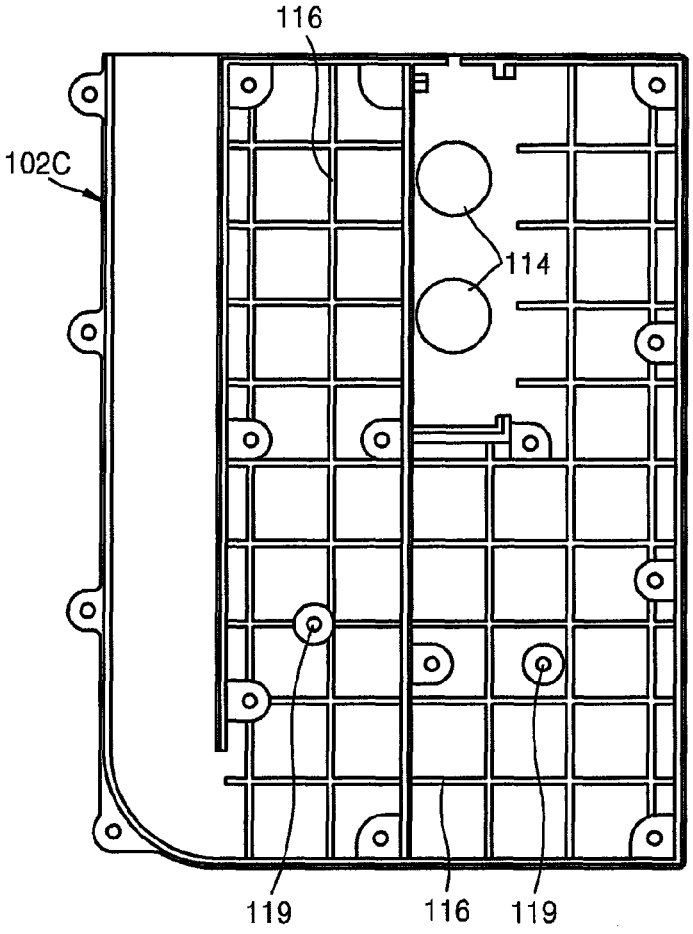
FIG. 5A is a plan view of an inner side surface of a first plate included in an enclosure according to an exemplary embodiment of the present invention.
Figure 5B:
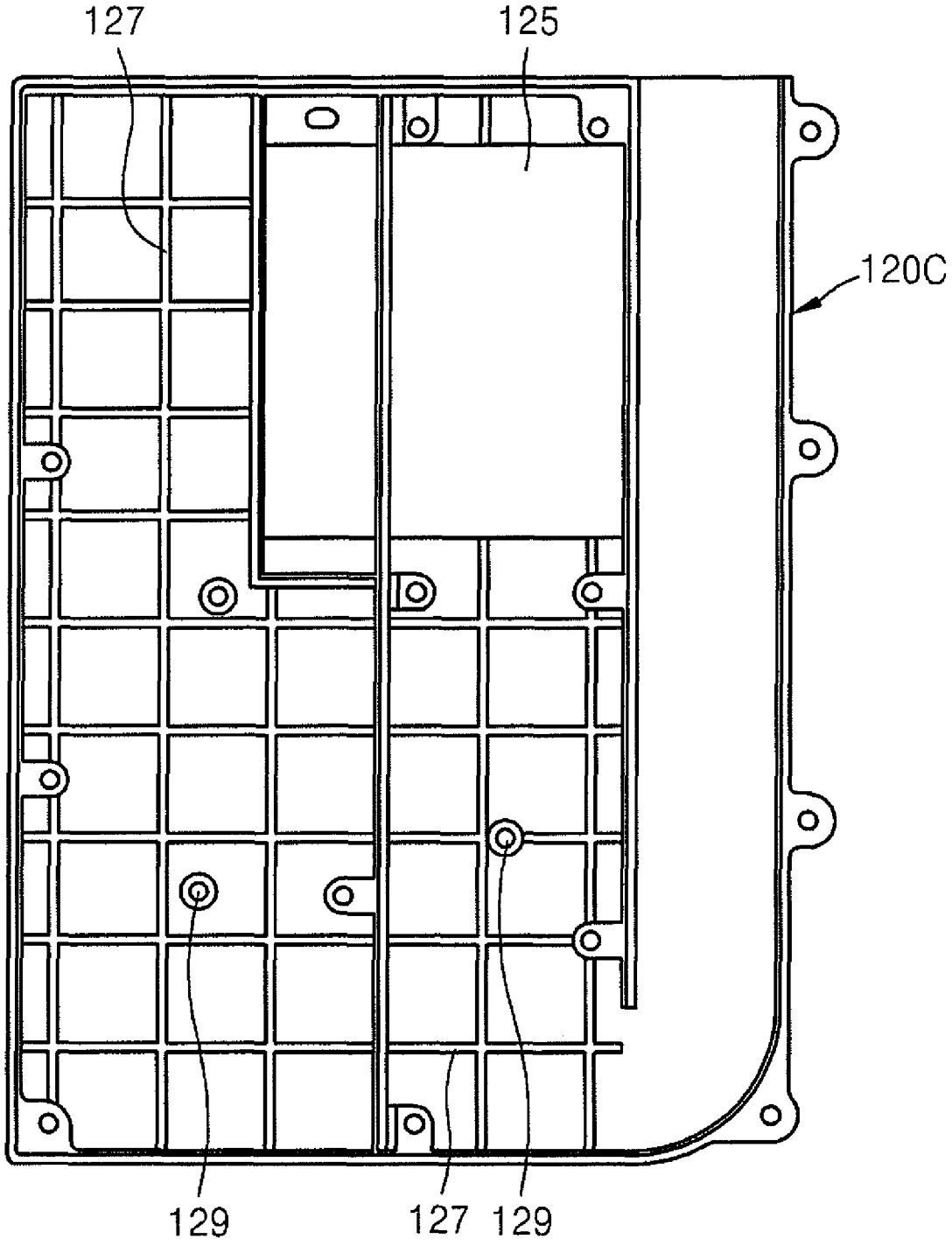
FIG. 5B is a plan view of an inner side surface of a second plate included in an enclosure according to an exemplary embodiment of the present invention.

FIG. 5A is a plan view of an inner side surface of a first plate 102C included in an enclosure according to an exemplary embodiment of the present invention. FIG. 5B is a plan view of an inner side surface of a second plate 120C included in an enclosure according to an exemplary embodiment of the present invention. The first plate 102C and the second plate 120C of the present exemplary embodiment are quite similar to the first plate 102B and the second plate 120B of the previous exemplary embodiment and are partially different from the first plate 102B and the second 120B. Like reference numerals denote like elements between the first plate 102C and the second plate 120C and the woofer 100B and thus the same descriptions thereof will not be repeated.

Referring to FIGS. 5A and 5B, the first plate 102C and the second plate 120C include a reinforcement unit that inhibits vibration thereof caused by sound vibration and reinforces rigidity. In more detail, two ribs 116 and 127 that protrude in the form of a check are formed in the inner side surfaces of the first plate 102C and the second plate 120C. Further, when the speaker unit 140 radiates the sound vibration (see FIGS. 3 and 4), two screw holes 119 and 129 used for screw locking are formed at an anti-node point in which a great vibration is detected, which prevents a reduction in a sound pressure level caused by vibration of the anti-node point. The anti-node point can be experimentally found.

FIG. 6 is a perspective view of an electronic device 10 according to an exemplary embodiment of the present invention. The electronic device 10 of the present exemplary embodiment is a digital TV but the present invention is not limited thereto. Referring to FIG. 6, the electronic device 10 includes the main body 12 that performs a previously established function and a pair of woofers 100B attached to the main body 12. If the electronic device 10 is the digital TV, the main body 12 performs a function of visually displaying a recognizable scene and audibly radiating recognizable sound. The main body 12 includes the flat display panel 15 that displays a scene, a bar type speaker 18 disposed in the lower portion of the flat display panel 15, and a support 20 that supports the flat display panel 15.

The woofer 100B is attached to the main body 12 so that the sound dispersion aperture 125 faces the main body 12, and the sound dispersion aperture 125 may be closed by the flat display panel 15. The speaker unit 140 radiates the sound vibration through the duct aperture 139 opened upward (see FIGS. 3 and 4).

Figure 7:
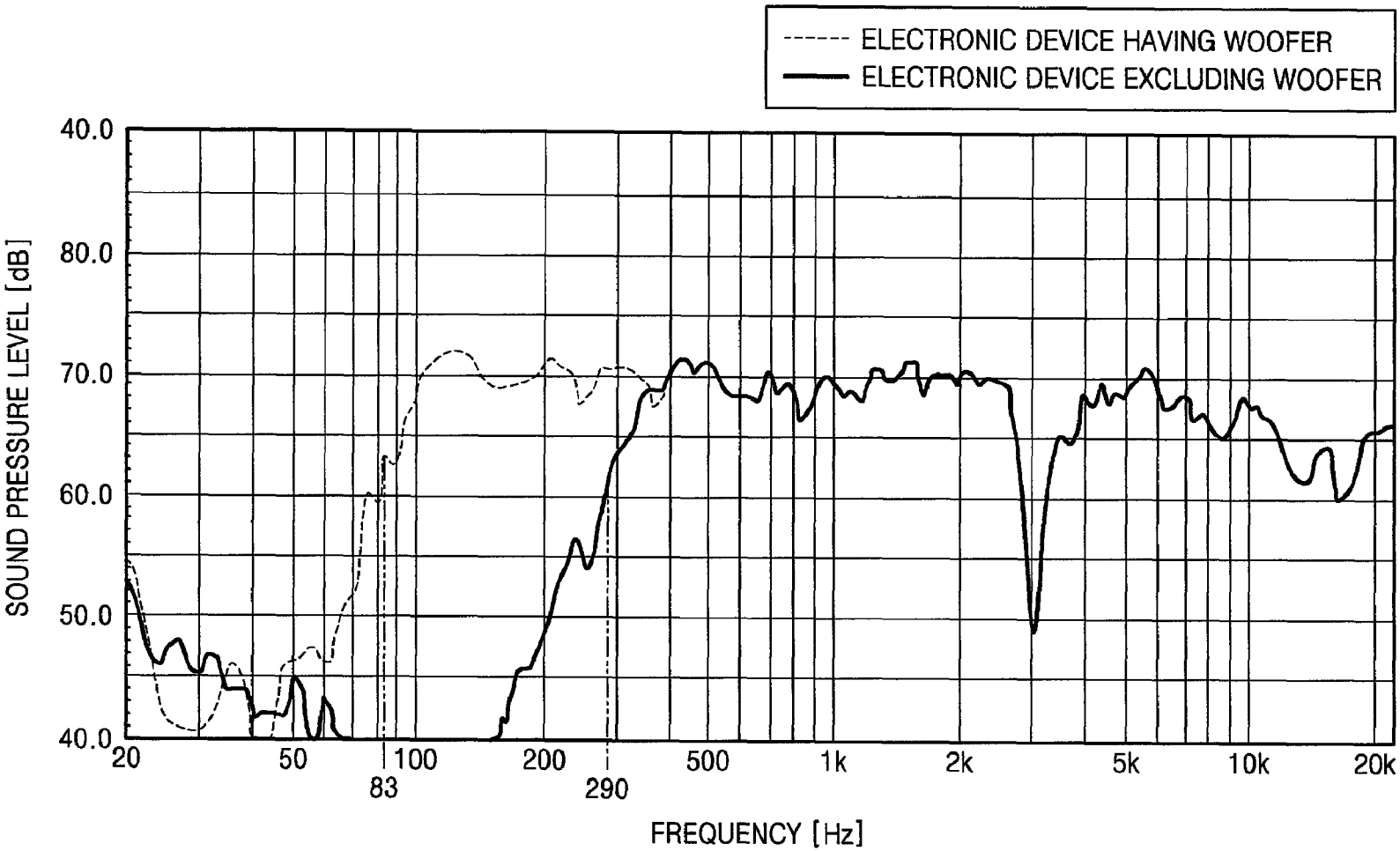
FIG. 7 is a graph of a sound pressure level of the electronic device of FIG. 6 according to an exemplary embodiment of the present invention.

FIG. 7 is a graph of a sound pressure level of the electronic device 10 of FIG. 6 according to an exemplary embodiment of the present invention. Referring to FIG. 7, the sound pressure level is measured 1.5 m in front of the electronic device 10 and is parametrically equalized (PEQ). A broken line indicates a sound pressure level of the electronic device 10 having a woofer. A solid line indicates a sound pressure level of the electronic device 10 excluding the woofer 100B.

The electronic device 10 excluding the woofer 100B has a 6 dB roll-off frequency of 290 Hz in which the sound pressure level rapidly falls by 6 dB in a low frequency band, whereas the electronic device 10 having the woofer has a 6 dB roll-off frequency of 83 Hz and thus a frequency of about 200 Hz is reduced. Therefore, sound is amplified by the frequency of about 200 Hz in the bass sound bandwidth.

While the present invention has been particularly shown and described with reference to preferred exemplary embodiments thereof, it will be understood by one of ordinary in the art that various changes in form and details may be made therein without departing from the spirit and scope of the invention as defined by the appended claims. The exemplary embodiments should be considered in a descriptive sense only and not for purposes of limitation. Therefore, the scope of the invention is defined not by the detailed description of the invention but by the appended claims, and all differences within the scope will be construed as being included in the present invention.

What is claimed is:

1. A woofer comprising:

an enclosure comprising a rear chamber, a speaker unit chamber disposed adjacent to the rear chamber and connected to the rear chamber such that air flows between the rear chamber and the speaker unit chamber across a first barrier rib, a front chamber disposed adjacent to the speaker unit chamber and connected to the speaker unit chamber such that air flows between the front chamber and the speaker unit chamber across a second barrier rib, and a duct having a first side connected to the front chamber such that air flows between the duct and the front chamber, and a second side opened to an outside, wherein the rear chamber, the speaker unit chamber, the front chamber, and the duct are disposed between a first plate and a second plate that are spaced apart from each other; and a speaker unit, which generates a sound vibration disposed in the speaker unit chamber such that a front surface faces the second plate.

2. The woofer of claim 1, wherein the rear chamber and the speaker unit chamber are connected such that air flows between the rear chamber and the speaker unit chamber through an aperture formed closer to the first plate than the second plate in the first barrier rib that partitions the rear chamber and the speaker unit chamber, and wherein the front chamber and the speaker unit chamber are connected such that air flows between the front chamber and the speaker unit chamber through an aperture formed closer to the second plate than the first plate in the second barrier rib that partitions the front chamber and the speaker unit chamber.

3. The woofer of claim 1, wherein a gap between the front surface of the speaker unit and an inner side surface of the second plate is greater than a maximum vibration amplitude of the speaker unit.

4. The woofer of claim 1, wherein an aperture which disperses the sound vibration generated by the speaker unit is formed in a portion of the second plate that overlaps each of the speaker unit chamber and the front chamber.

5. The woofer of claim 4, wherein, when an aperture of the second plate is closed by a virtual flat plate wider than the second plate, a gap between the front surface of the speaker unit and the inner side surface of the virtual flat plate is greater than the maximum vibration amplitude of the speaker unit.

6. The woofer of claim 1, wherein an aperture is formed in a portion of the first plate that overlaps the speaker unit chamber, and the speaker unit is partially inserted into the aperture formed in the first plate.

7. The woofer of claim 1, wherein the first plate or the second plate comprises a reinforcement unit which inhibits vibration and reinforces rigidity.

8. The woofer of claim 1, wherein the rear chamber and the speaker unit chamber are spaced apart from the duct by the front chamber.

9. An electronic device comprising:

a main body which performs a previously established function; and a woofer, attached to the main body, which amplifies a bass sound, wherein the woofer comprises an enclosure comprising a rear chamber, a speaker unit chamber disposed adjacent to the rear chamber and connected to the rear chamber such that air flows between the rear chamber and the speaker unit chamber across a first barrier rib, a front chamber disposed adjacent to the speaker unit chamber and connected to the speaker unit chamber such that air flows between the front chamber and the speaker unit chamber across a second barrier rib, and a duct having a first side connected to the front chamber such that air flows between the duct and the front chamber and a second side opened to an outside, wherein the rear chamber, the speaker unit chamber, the front chamber, and the duct are disposed between a first plate and a second plate that are spaced apart from each other; and a speaker unit which generates a sound vibration disposed in the speaker unit chamber such that a front surface faces the second plate.

10. The electronic device of claim 9, wherein the rear chamber and the speaker unit chamber are connected to each other such that air flows between the rear chamber and the speaker unit chamber through an aperture formed closer to the first plate than the second plate in the first barrier rib that partitions the rear chamber and the speaker unit chamber, and wherein the front chamber and the speaker unit chamber are connected to each other such that air flows between the front chamber and the speaker unit chamber through an aperture formed closer to the second plate than the first plate in the second barrier rib that partitions the front chamber and the speaker unit chamber.

11. The electronic device of claim 9, wherein a gap between the front surface of the speaker unit and an inner side surface of the second plate is greater than a maximum vibration amplitude of the speaker unit.

12. The electronic device of claim 9, wherein an aperture which disperses the sound vibration generated by the speaker unit is formed in a portion of the second plate that overlaps the speaker unit chamber and the front chamber.

13. The electronic device of claim 12, wherein the aperture formed in the second plate is closed by a portion oldie main body.

14. The electronic device of claim 13, wherein a gap between the front surface of the speaker unit and a portion of the main body is greater than a maximum vibration amplitude of the speaker unit.

15. The electronic device of claim 9, wherein an aperture is formed in a portion of the first plate that overlaps the speaker unit chamber, and the speaker unit is partially inserted into the aperture formed in the first plate.

16. The electronic device of claim 9, wherein the first plate or the second plate comprises a reinforcement unit that inhibits vibration and reinforces rigidity.

17. The electronic device of claim 9, wherein the rear chamber and the speaker unit chamber are spaced apart from the duct by the front chamber.

18. A woofer comprising:

a base plate comprising a plurality of partitions which create a plurality of chambers and a duct;

a top plate which, when coupled to the base plate, forms an enclosure; and a speaker which is disposed between two of the plurality of partitions;

wherein each of the plurality of partitions comprises an opening which allows for communication between the plurality of chambers; and the duct is the only portion of the enclosure that communicates with the atmosphere.

* * * * *